United States Patent [19]

Yajima et al.

[11] 4,127,411

[45] Nov. 28, 1978

[54] HEAT RESISTANT AND SUPER HARD COMPOSITE MATERIALS AND A METHOD FOR PRODUCING THE SAME

[75] Inventors: Seishi Yajima; Toetsu Shishido; Mamoru Omori; Hideo Kayano; Masaaki Hamano, all of Oharai, Japan

[73] Assignee: The Foundation: The Research Institute for Special Inorganic Materials, Asahi, Japan

[21] Appl. No.: 754,215

[22] Filed: Dec. 27, 1976

[30] Foreign Application Priority Data

Dec. 29, 1975 [JP] Japan ..... 51-157769

[51] Int. Cl.[2] ..... B22F 3/00

[52] U.S. Cl. ..... 75/236; 75/203; 75/204; 75/201; 106/44

[58] Field of Search ..... 106/44, 52; 425/345; 75/203, 204, 201, 236

[56] References Cited

U.S. PATENT DOCUMENTS 3,488,291 1/1970 Hardy et al. ..... 75/204

FOREIGN PATENT DOCUMENTS 2,236,078 3/1974 Fed. Rep. of Germany.

*Primary Examiner*—Brooks H. Hunt

*Attorney, Agent, or Firm*—Ladas, Parry, Von Gehr, Goldsmith & Deschamps

[57] ABSTRACT

Heat resistant and super hard composite materials are produced by mixing not more than 60% by weight of an organosilicon high molecular weight compound, the main skeleton components of which are silicon and carbon or an organosilicon high molecular weight compound, the main skeleton components of which are silicon and carbon and which contains foreign elements other than silicon, carbon, hydrogen and oxygen with not less than 40% by weight of metal material powders consisting mainly of at least one metal element, molding the mixture into a shaped article and baking the shaped article under a non-oxidizing atmosphere at a temperature of lower than the semi-melting point of the above described metal powders.

6 Claims, 2 Drawing Figures

Figure 1:
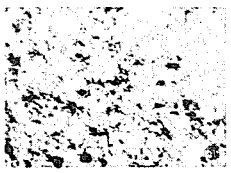

HEAT RESISTANT AND SUPER HARD COMPOSITE MATERIALS AND A METHOD FOR PRODUCING THE SAME

The present invention relates to heat resistant and super hard composite materials consisting mainly of a metal carbide and the above described metal and a method for producing the same.

Heretofore, super hard alloys or cermets obtained by sintering a metal carbide and a metal other than the above described metal, have been known.

The metal carbides are very high in the hardness and high in the melting point but is brittle and it is impossible to produce moldings having a high mechanical strength only by the carbide, so that the cermet is a composite material consisting of a carbide and a metal which is one other than the metal constituting the carbide and is used as a binder. One of the typical cermets is stellite which contains WC, $Cr_3C_2$, VC and the like and uses Fe or Co as a binder and is used for super hard tools and includes WC—Co series, WC—TiC—Co series, WC—TiC—Ta(Nb)C—Co series and the like.

In this cermet, the carbides which are the matrix, are very hard but the carbides themselves have no sintering ability, so that metals having a relatively high melting point, for example Co, Ni, Cr, Fe and the like should be used as the binder. However, when the above described cermets are used as a tool for cutting at a high speed, the top of the cutting edge may reach the temperature near the melting point of the metal used as the binder upon cutting and the carbide at the top of the cutting edge separates and falls from the binding metal, so that it is necessary to lower the cutting speed in order to avoid this defect.

An object of the present invention is to provide heat resistant and super hard composite meterials in which the essential defects possessed by the above described super hard materials already known, such as cermets are obviated and a method for producing the same.

The heat resistant and super hard composite materials according to the present invention consist mainly of a metal carbide having a super hardness and the metal constituting said carbide and may contain a small amount of a silicate of the above described metal or $\beta$ type SiC.

The invention will be explained in detail hereinafter.

The composite materials according to the present invention are novel sintered composite materials consisting mainly of a heat resistant and super hard metal carbide and the metal constituting the above described carbide, which may contain a small amount of a metal silicate and $\beta$-SiC.

The metal carbides contained in the composite materials according to the present invention involve the metal carbides having a larger hardness and a higher melting point among the already known metal carbides. The typical metal carbides are shown in the following Table 1.

Table 1

| Carbides | Microhardness (kg/mm$^2$) | Melting point (° C) |
|---|---|---|
| $Be_2C$ | 2700 | 2400 |
| $B_4C$ | 5000 | 2450 |
| $\alpha$-SiC | 3350 | 2700 |
| $\beta$-SiC | 3400 | 2700 |
| TiC | 3200 | 3250 |
| ZrC | 2600 | 3540 |
| HfC | 2900 | 3890 |
| VC | 2800 | 2830 |

Table 1-continued

| Carbides | Microhardness (kg/mm$^2$) | Melting point (° C) |
|---|---|---|
| NbC | 2400 | 3500 |
| TaC | 1800 | 3880 |
| ThC | 1000 | 2625 |
| UC | 700 | 2390 |
| WC | 1800 | 2600 |
| $Mo_2C$ | 1800 | 2687 |
| $W_2C$ | 3000 | 2750 |
| $Cr_3C_2$ | 1650 | 1915 |
| $Cr_7C_3$ | 2100 | 1782 |
| $Cr_{23}C_6$ | 1650 | 1518 |

The hardness of these carbides is larger than that of the other carbides and the melting point ranges from a relatively low melting point of $Cr_{23}O_6$ of 1518° C. to a very high melting point of HfC of 3890° C. and the most prefearable metal carbide can be selected depending upon the use and the using condition. In the composite materials according to the present invention it is possible to contain at least one of the above described carbides and when two or more carbides are contained, the metals constituting the respective carbides may be contained.

The metals to be used in the present invention are ones constituting the above described metal carbides and for example, the metals constituting the carbides shown in Table 1 can be advantageously used.

The metals mainly constituing the binder in the conventional cermets are Co, Cr, Fe, Ni and so on and the metal having the highest melting point among these metals is Cr and said melting point is 1615° C., so that, for example when the cermet using Cr as the binder cannot be apparently used only at a temperature of lower than the said temperature. On the contrary, in the composite materials according to the present invention the metals having a super high melting point, such as tungsten having a melting point of 3370° C. or tantalum having a melting point of 3027° C. can be advantageously used and in this point, the present invention can provide quite novel composite materials.

Table 2

| Metal element | Melting point (° C) |
|---|---|
| Be | 1285 |
| B | 2300 |
| Si | 1420 |
| Ti | 1800 |
| Zr | 1857 |
| Hf | 2230 |
| V | 1710 |
| Nb | 2520 |
| Ta | 3027 |
| Th | 1842 |
| U | 1690 |
| W | 3370 |
| Mo | 2620 |
| Cr | 1615 |

The metal silicates, if necessary constituting a part of the composite material of the present invention are silicates of at least one metal among the metals constituting the above described composite materials and for example, the silicates produced from the metals disclosed in Table 2 are Be—Si, B—Si, Ti—Si, Zr—Si, Hf—Si, V—Si, Nb—Si, Ta—Si, Th—Si, W—Si, Mo—Si, Cr—Si and the like. For example, in Ta—Si series, Ti—Si series and W—Si series, $Ta_5Si_3$ (2500° C.), $Ti_5Si_3$ (2120° C.) and $W_5Si_3$ (2380° C.) may be contained as the metal silicates in the composite materials according to the present invention respectively.

The composite materials according to the present invention may contain $\beta$—SiC.

Then, an explanation will be made with respect to the textural structure of the composite materials of the present invention.

The composite materials of the present invention consist mainly of the mutual sintered texture of the metal material powders to be used and the bonding texture of the above described metal to the carbide of said metal and in addition, may have the bonding texture due to the metal silicate or $\beta$-SiC.

The above described mutual sintered texture of the metal material powders is strong and the surfaces of the metal material powders and the sintered metal powders are covered by the above described metal carbide and the carbon penetrates into the surface layer of the metal material powders. In the carbon penetrating layer, the metal phase and the metal carbide phase are not distinctly comparted into two phases by a boundary face and the metal phase gradually transfers to the metal carbide phase, so that it is very difficult to separate the metal phase and the carbide phase by an outer force. The drawings show a microscopic photograph showing the cross-section of the texture of the composite material of the present invention consisting of 80% by weight of titanium powders and 20% by weight of polycarbosilane and a sintered body of titanium powders.

When the silicate of the same metal as the metal powder to be added in the present invention or $\beta$-SiC is contained, the silicate or $\beta$-SiC coexists in the above described carbon penetrating layer and has a function for improving the hardness of metal.

In the composite materials of the present invention, the volume ratio of the metal phase and the carbon penetrating layer of the textural structure is 100:2–98.

An explanation will be made with respect to various properties of the composite materials of the present invention.

The composite materials of the present invention are larger in the hardness and strength than the conventional cermets of the carbides and have excellent heat resistance and oxidation resistance. An embodiment of comparison of the hardness of the conventional cermet with that of the composite material of the present invention is shown in the following Table 3.

Table 3

| | Vickers hardness |
|---|---|
| WZ super hard alloy | 600 - 1070 |
| Ti-TiC series composite material of the present invention | 1540 - 2170 |

As seen from the above data, the hardness of the composite material of the present invention is far larger than that of the conventional cermet and is 2–2.5 times as high as the conventional cermet having the similar components. Furthermore, the strength is larger in proportion to the hardness and an embodiment of the comparison of strength of the conventional cermet with that of the composite material of the present invention is shown in the following Table 4.

Table 4

| | Flexural strength (kg/mm$^2$) |
|---|---|
| WC series cermet | 12,250 - 21,000 |
| W-WC series composite material of the present invention | 21,500 - 39,800 |

As seen from the above data, the flexural strength of W—WC series composite material according to the present invention is about twice as high as that of WC series cermet.

The composite materials of the present invention are the super hard composite materials having a very high strength. This high strength is developed even at a high temperature and this is shown in the following Table 5.

Table 5

| | Tensile strength (kg/mm$^2$) | |
|---|---|---|
| | 20° C | 900° C |
| WZ super hard alloy | 60 - 109 | 38 - 50 |
| Ti-TiC series composite material of the present invention | 150 - 270 | 98 - 180 |

As seen from the above date, the tensile strength at 20° C. of Ti—TiC series composite material of the present invention is about 2–2.5 times as larger as that of WZ super hard alloy and the tensile strength at 900° C. is about 2.5–3 times and therefore, the composite materials of the present invention develop the strength property at a high temperature.

The composite materials according to the present invention are very excellent in the oxidation resistance and this is shown in the following Table 6.

Table 6

| | Weight decrease g/cm$^2$/hr | | | |
|---|---|---|---|---|
| | 600° C | 700° C | 800° C | 900° C |
| 94WC-6Co cermet | 0.4 | 11.0 | 44.0 | 67.6 |
| W(51%), WC (27%), SiC (10%), Si (2%) composite material of the present invention | 0.1 | 1.1 | 2.9 | 4.2 |

The composite material of the present invention is far more excellent in the oxidation resistance at a high temperature than the conventional cermet having the similar components and at 900° C., the weight decrease due to oxidation of the composite material of the present invention is 15 times as good as that of the conventional material.

As explained hereinbefore, the composite materials of the present invention are entirely different in the textural structure from the conventional heat resistant and super hard materials and are far more excellent in the hardness, strength, heat resistance and oxidation resistance than the conventional heat resistant and super hard materials.

Then, an explanation will be made with respect to the method for producing the composite materials according to the present invention.

One of the starting materials to be used for production of the composite materials according to the present invention is the organosilicon higher molecular weight compounds wherein the main skeleton components are carbon and silicon and the method for producing these compounds have been already disclosed is U.S. Pat. application Ser. Nos. 677,959 and No. 677,960.

The organosilicon compounds to be used as the starting material for producing the organosilicon high molecular weight compounds, the main skeleton components of which are carbon and silicon, are at least one of the organosilicon compounds classified by the following groups (1)–(10).

(1) Compounds having only Si—C bond:

Silahydrocarbons, such as $R_4Si$, $R_3Si(R'SiR_2)_nR'SiR_3$, carbon-functional derivatives thereof belong to this group. For example, $(CH_3)_4Si$, $(CH_2{=}CH)_4Si$, $(CH_3)_3SiC{\equiv}CSi(CH_3)_3$, $(CH_2)_5Si(CH_2)_4$, $(C_2H_5)_3SiCH_2CH_2Cl$, $(C_6H_5)_3SiCO_2H$,

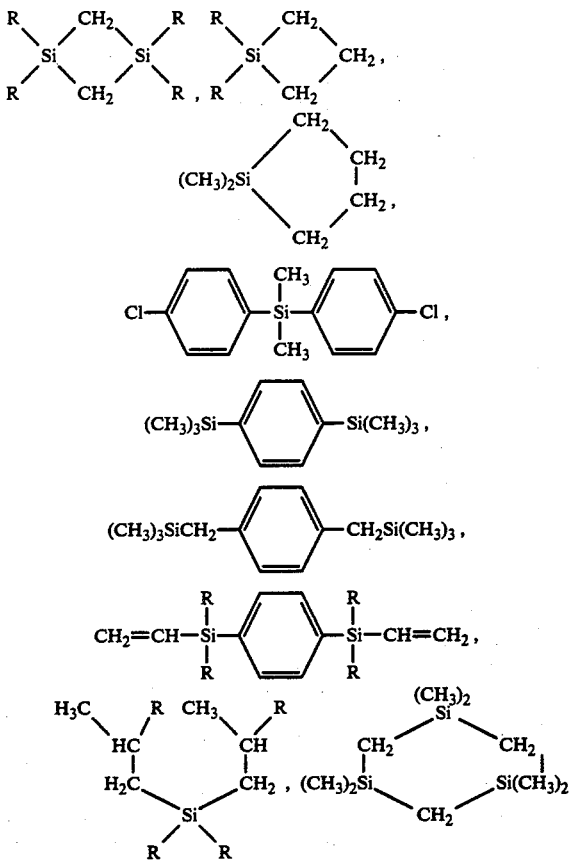

(2) Compounds having Si—H bond in addition to Si—C bond: Mono-, di-, and triorganosilanes belong to this group.

For example, $(C_2H_5)_2SiH_2$, $(CH_2)_5SiH_2$, $(CH_3)_3SiCH_2Si(CH_3)_2H$, $ClCH_2SiH_3$,

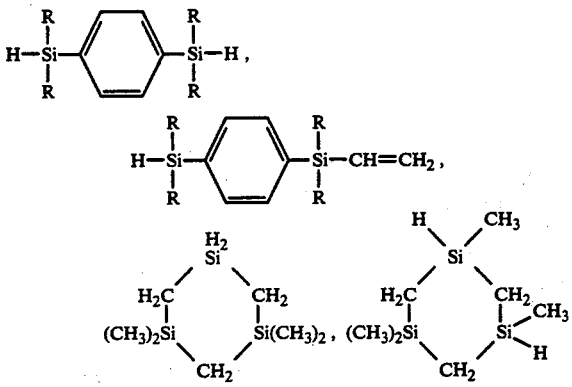

(3) Compounds having Si—Hal bond: Organohalogensilanes.

For example, $CH_2{=}CHSiF_3$, $C_2H_5SiHCl_2$, $(CH_3)_2(ClCH_2)SiSi(CH_3)_2Cl$, $(C_6H_5)_3SiBr$,

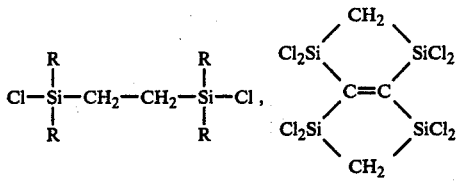

(4) Compounds having Si—N bond: Silylamines beong to this group.

For example,

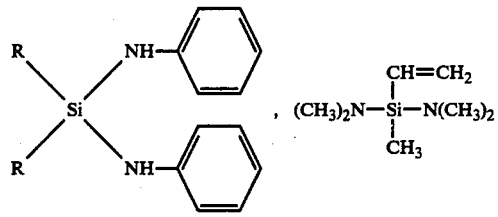

(5) Si—OR organoalkoxy (or aroxy) silanes:

For example, $(CH_3)_2Si(OC_2H_5)_2$, $C_2H_5SiCl_2(OC_2H_5)$, $p\text{-}ClC_6H_4OSi(CH_3)_3$,

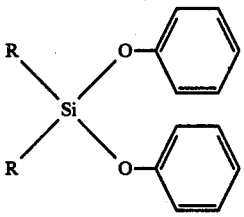

(6) Compounds having Si—OH bond: Organosilanols.

For example, $(C_2H_5)_3SiOH$, $(CH_3)_2Si(OH)_2$, $C_6H_5Si(OH)_3$, $(HO)(CH_3)_2SiCH_2Si(CH_3)_2.(OH)$,

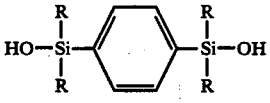

(7) Compounds having Si—Si bond:

For example, $(CH_3)_3SiSi(CH_3)_2Cl$, $(CH_3)_3SiSi(CH_3)_3$, $(C_6H_5)_3SiSi(C_6H_5)_2Si(C_6H_5)_2Cl$,

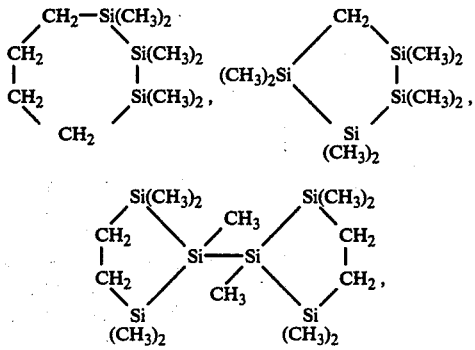

-continued

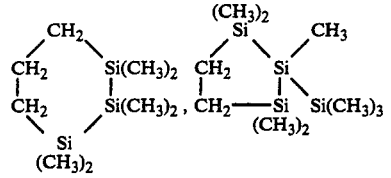

(8) Compounds having Si—O—Si bond: Organosiloxanes.

For Example, $(CH_3)_3SiOSi(CH_3)_3$, $HO(CH_3)_2SiOSi(CH_3)_2OH$, $Cl_2(CH_3)SiOSi(CH_3)ClOSi(CH_3)Cl_2$, $[(C_6H_5)_2SiO]_4$, $CH_2{=}C(CH_3)CO_2CH_2Si{\cdot}(CH_3)_2CH_2O_2C(CH_3){=}CH_2$

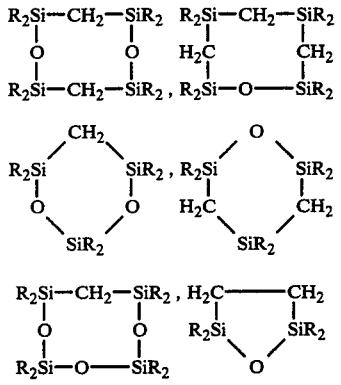

(9) Esters of organosilicon compounds: Esters formed from silanols and acids.

$(CH_3)_2Si(OCOCH_3)_2$

(10) Peroxides of organosilicon compounds:

$(CH_3)_3SiOOC{\cdot}(CH_3)_3$, $(CH_3)_3SiOOSi(CH_3)_3$

In the above formulae, R shows alkyl or aryl group.

These starting materials are subjected to polycondensation reaction through at least one process of irradiation, heating and addition of a catalyst for the polycondensation to produce the organosilicon high molecular weight compounds, in which silicon and carbon are the main skeleton components. For example, compounds having the following molecular structures are produced.

(a)

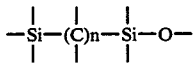

(b)

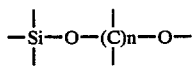

(c)

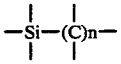

(d) The compounds having the above described skeleton components (a)–(c) as at least one partial structure in linear, ring and three dimensional structures or mixtures of the compounds having the above described skeleton components (a)–(c).

The compounds having the above described molecular structures are, for example as follows:

(a)

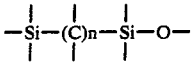

$n=1$, poly(silmethylenesiloxane),
$n=2$, poly(silethylenesiloxane),
$n=6$, poly(silphenylenesiloxane)

(b)

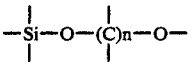

$n=1$, poly(methyleneoxysiloxane),
$n=2$, poly(ethyleneoxysiloxane),
$n=6$, poly(phenyleneoxysiloxane),
$n=12$, poly(diphenyleneoxysiloxane)

(c)

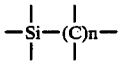

$n=1$, polysilmethylene,
$n=2$, polysilethylene,
$n=3$, polysiltrimethylene,
$n=6$, polysilphenylene,
$n=12$, polysildiphenylene (d) The compounds having the above described skeleton components as at least one partial structure in linear, ring and three dimensional structures of mixtures of the compounds having the above described skeleton components (a)–(c).

As the organosilicon high molecular weight compounds containing foreign elements other than silicon, carbon, hydrogen and oxygen atoms to be used in the present invention, mention may be made of the following compound having molecular structures (e), (f) and (g).

(e)

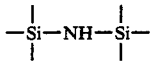

polysilasanes (f)

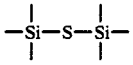

polysilthianes (g) polymers having carborane nucleus.

The above described organosilicon high molecular weight compounds containing the foreign elements are sythesized by the publicly well known processes. Other than the above described organosilicon high molecular weight compounds containing the foreign elements, the organosilicon high molecular weight compounds containing foreign elements other than silicon, carbon, hydrogen and oxygen can be produced by the process disclosed in Japanese Patent Application No. 149468/75 filed on Dec. 17, 1975. Namely, to at least one of the organosilicon compounds shown by the above described groups (1)–(10) except for (4) is added at least one organometallic compound selected from the groups (4) and (11)–(18) and the mixture is subjected to polycondensation reaction by heating at a temperature of 200°-1500° C. under a non-oxidizing atmosphere to produce the organosilicon high molecular weight compounds containing foreign elements other than silicon, carbon, hydrogen and oxygen.

(11) Organometallic compounds containing metals of Group I (containing coordination compounds)

For example, $CH_3Li$, $C_2H_5Na$, $C_6H_5Li$,
$KCH_3$, $AgCH_3$, $AuC_3H_9$

(12) Organometallic compounds containing metals of Group II (containing coordination compounds)

For example, $BeC_2H_6$, $MgCH_2$, $CaC_2H_6$, $BaC_2H_6$,
$ZnC_4H_{10}$, $CdC_2H_6$, $HgCH_3Br$, $CrC_2H_6$

(13) Organometallic compounds containing metals of Group III (containing coordination compounds)

For example, $BCH_5O_2$, $BC_3H_9$, $AlC_2H_7$, $GaCH_3O$,
$InC_2H_8N$, $InC_3H_9$, $TlC_3H_9$,
$Sc(CH_3COCHCOH_3)_3$, $La(CH_3COCHCOCH_3)_3$,
$Ce(CH_3COCHCOCH_3)_4$, $Pr(CH_3COCHCOCH_3)_3$,
$Nd(CH_3COCHCOCH_3)_3$, $Sm(CH_3COCHCOCH_3)_3$,
$Eu(CH_3COCHCOCH_3)_3$, $Gd(CH_3COCHCOCH_3)_3$,
$Tb(CH_3COCHCOCH_3)_3$, $Py(CH_3COCHCOCH_3)_3$,
$Ho(CH_3COCHCOCH_3)_3$, $Er(CH_3COCHCOCH_3)_3$,
$Tm(CH_3COCHCOCH_3)_3$, $Yb(CH_3COCHCOCH_3)_3$,
$Ln(CH_3COCHCOCH_3)_3$

(14) Organometallic compounds containing metals of Group IV (containing coordination compounds)

For example, $HfC_{10}H_{10}Cl_2$, $GaC_2H_8$, $SnC_2H_8$, $PbC_2H_8$,
$TiC_{10}H_{10}$, $ZrC_{10}H_{10}Cl_2$

(15) Organometallic compounds containing metals of group V (containing coordination compounds)

For example, $VC_6O_6$, $NbC_6O_6$, $TaC_6O_6$, $C_4H_4N$, $PC_2H_5O_5$,
$PC_2H_7$, $AsCH_3S$, $AsC_2H_7$, $SbC_2H_7$, $BiC_3H_9$

(16) Organometallic compounds containing metals of Group VI (containing coordination compounds)

For example, $WC_8H_6O_3$, $C_2H_5SH$, $SeCH_2$, $TeC_2H_6$, $PoC_2H_6$,
$MoC_6H_6$, $CrC_6H_8N_2O_2$

(17) Organometallic compounds containing metals of Group VII (containing coordination compounds)

For example, $MnC_{12}H_{10}$, $TcC_{10}H_{10}$, $ReC_6H_3O_5$

(18) Organometallic compounds containing metals of Group VIII (containing coordination compounds)

For example, $FeC_{10}H_{10}$, $CoC_6H_5O_3$, $NiC_6H_{10}$, $RuC_{10}H_{10}$, $RhC_9H_{13}$,
$PdC_8H_{10}$, $PdC_5H_5Cl$, $OsC_{10}H_{10}$, $IrC_3O_3$, $PtC_4H_{12}$ At least one of the organosilicon high molecular weight compounds, the main skeleton components of which are silicon and carbon and which have the molecular structures shown by the above formulae (a)-(d), the organosilicon high molecular weight compounds containing foreign elements other than silicon, carbon, hydrogen and oxygen, which are the polymers shown in the above (e)-(g) and the organosilicon high molecular weight compounds containing foreign elements other than silicon, carbon, hydrogen and oxygen obtained by polycondensing at least one of the organosilicon compounds having the above described formulae (1)-(10) except for (4) with at least one organometallic compounds shown by the groups (4) and (11)-(18), is used in the production of the heat resistant and super hard composite materials of the present invention.

In the above described organosilicon high molecular weight compounds, more than 1 moles of carbon are contained based on 1 mole of silicon, so that the baked product composed of $\beta$-SiC type crystal obtained by baking the organosilicon high molecular weight compounds under a non-oxidizing atmosphere contain more than 0.01% by weight of free carbon.

Not more than 60% by weight of the above described organosilicon high molecular weight compound is mixed with the remainder being the metal powders. The above described organosilicon high molecular weight compound is heated and melted or is dissolved in a solvent capable of dissolving said organosilicon high molecular weight compound, for example benzene, toluene, xylene, ethylbenzene, styrene, cumene, pentane, hexane, octane, cyclopentadiene, cyclohexane, cyclohexene, methylene chloride, chloroform, carbon tetrachloride, 1,1-dichloroethane, 1,2-dichloroethan, methylchloroform, 1,1,2-trichloroethane, hexachloroethane, chlorobenzene, dichlorobenzene, ethyl ether, dioxane, tetrahydroform, methyl acetate, ethyl acetate, acetonitrile, carbon disulfide and so on, and then to the melted organosilicon high molecular weight compound or the obtained solution are added the metal material powders and the mixture is mixed with a mixer, such as ball mill, double corn mixer, rotary drum and mixer. It is preferable that the mixing is carried out until the metal powders are fully coated and impregnated with the organosilicon high molecular weight compound.

The mixing ratio of the organosilicon high molecular weight compound should be not more than 60% by weight, because when the amount exceeds 60% by weight, even if a shaped article is obtained in the molding step, a large amount of volatile components formed through the decomposition of the organosilicon high molecular weight compound are evolved upon the baking step and the decomposed product reacts vigorously with the metal powders and the shape of the molding collapses, so that such a large amount is not preferable and the amount should be not more than 60%.

When the above described mixing is effected by using the heated and melted organosilicon high molecular weight compound, the mixture can be molded during the melted state or at room temperature. When the mixing is effected by using a solution of the organosilicon high molecular weight compound in a solvent, if necessary, the solvent is removed and then the molding may be effected.

For the formation of the above described molding, the molding under no pressure or under pressure may be carried out.

In the molding under no pressure, the mixture is charged in a mold to form a shaped article and then the shaped article is baked under a non-oxidizing atmosphere to obtain the molding. The thus formed molding is relatively low in the density.

The molding under pressure can be carried out by the following processes, that is (1) press process, (2) centrifugal pressure process, (3) extrusion process, (4) hydrostatic pressure process, (5) high temperature pressure process, (6) high energy pressure process and the like.

(1) In the press process, the molding is effected by means of a die, a punch or a press, so that a precise molding can be produced. According to a low pressure press, a molding having a relatively low density can be obtained and when the pressure of press becomes large, it is possible to make the density of the molding large.

(2) In the centrifugal press process, a mold wherein the powdery mixture is charged, is set on a high speed rotator and the powdery mixture is forced to the wall of the mold by the centrifugal force directing from the center to the outside, so that the pressure is directly applied to each particle, so that the uniform density is easily obtained. Furthermore, the organosilicon high molecular weight compound contained in the molding decreases the friction between particles and serves to make the molding better.

(3) In the extrusion process, the organosilicon high molecular weight compound contained in the mixture becomes a binder and permits the metal powders to be formed into a paste. However, in order to give fluidity, if necessary, when at least one compound of an organic compound and an organic high molecular weight compound is added, the extrusion molding can be advantageously effected. The extrusion can be conducted at either room temperature or a high temperature depending upon the state of the paste.

(4) In the hydrostatic pressure process the pressure is applied to the molding from all directions, that is upper, lower, left and right directions, so that the molding having a uniform density can be obtained.

(5) In the high temperature pressure process, the pressure molding and the braking are concurrently effected under a non-oxidizing atmosphere and the baking condition may be the same as the usual baking condition of the molding.

(6) In the high energy pressure process, the pressure is applied by using a large energy, such as explosion but the strength and the hardness of the molding are not so improved, so that this process is not so advantageous.

The molding obtained by the above described various processes is baked under at least one non-oxidizing atmosphere selected from vacuum, inert gas (nitrogen gas, argon gas, helium gas and the like), hydrogen gas, CO gas, $CO_2$ gas, hydrocarbon gas and organosilicon gas to obtain the heat resistant and super hard composite material.

The baking temperature is preferred to be lower than semi-melting temperature of the metal powder. The rate of raising temperature in the baking is preferred to be less than 1500° C./hr and when the temperature is raised at a rate of more than 1500° C./hr, the decomposition of the organosilicon high molecular weight compound becomes rapid and the reaction of the decomposed product with the metal powders occurs rapidly, so that the shape of the molding collapses and cracks are readily formed. Accordingly, the rate for raising temperature is better to be as slow as possible. When the molding is baked under an oxidizing atmosphere, the above described organosilicon high molecular weight compound and the metal powders are oxidized, so that the atmosphere for baking must be non-oxidizing atmosphere. In order to maintain the shape of the molding upon baking, if the molding is put in a mold and baked or the molding is held by the powders which do not react with the molding, for example, heat resistant powders, such as ceramic powders and heat resistant metal powders, the baking can be advantageously effected.

In the above described baking, the organosilicon high molecular weight compounds, the main skeleton components of which are silicon and carbon react with the metal powders directly or after decomposition and simultaneously form silicon carbide.

The metal materials (metal, alloy, intermetallic compound) capable of forming the super high carbides among metal materials, for example consisting of at least one of metals of zirconium, hafnium, titanium, thorium, uranium, chromium, aluminum, silicon, tungsten, vanadium, molybdenum, manganese, boron, niobium, tantalum, beryllium and so on, react easily with carbon formed by the decomposition to form the super hard carbides.

According to the present invention, the organosilicon high molecular weight compounds mixed in the starting material are baked to form $\beta$-type crystal of SiC. The hardness of the formed SiC is high as shown in the above described Table 1 and the oxidation resistance is very excellent. A part of silicon in the organosilicon high molecular weight compounds react with the metal material in the baking step to form an alloy containing silicon. The hardness of the above described metal material containing silicon becomes large.

When the organosilicon high molecular weight compound and the metal material powders are baked, the metal powders are sintered with one another and at the same time the organosilicon high molecular weight compound and the decomposed product react with the metal material powders to form the metal carbides and the metal silicates and further the organosilicon high molecular weight compound is baked to form silicon carbide and this silicon carbide serves to bond the metal material powders. By the above described three functions, that is the mutual sintering of the metal powders, the reaction for formation of the metal carbides and the silicates and the bonding action of SiC, the molding becomes the composite material having a very large hardness. When the metal powders containing at least one of metals of Ti, Zr, Hf, Th, U, Cr and so on, which form more stable carbide than SiC, are used as the metal powders, the formation of $\beta$-SiC in the composite material is prevented.

If the metal powders containing at least one of the metals other than the metals forming the more stable carbide than SiC are used, the formation of the silicate is difficult. The reaction of the metal material powders with the organosilicon high molecular weight compound or the decomposed product is different from the sintering temperature of the conventional powder metallurgy process and begins from a relatively low temperature of about 500° C. and the reaction completes relatively rapidly at a lower temperature. Furthermore, the present invention is different from the sintering mechanism of the conventional powder metallurgy and in the present invention, the reaction for forming the carbide and silicate and the bonding reaction due to the formation of SiC are added to the sintering, so that the uniform property is obtained in any portion of the molding and this is a great characteristic.

By using the organosilicon high molecular weight compound containing the foreign elements other than silicon, carbon, hydrogen and oxygen, various foreign element can be uniformly contained in the composite material, so that such a use is advantageous. According to the present invention, silicon carbide protects the surface of the composite material, so that the heat resistance of the composite material becomes high and by the carbon solid dissolved in the metal material, the formed metal carbide, silicate and silicon carbide, the composite material becomes hard.

The metal element in the composite material according to the present invention is partially converted into the carbide and silicate and the other part may be metal itself, alloy or intermetallic compound and the very excellent composite material in which the respective properties of the carbide or silicate having a high hardness and the metal material having a high toughness and the other excellent mechanical properties are completely integrated, can be obtained.

For a better understanding of the invention, reference is taken to the accompanying drawings.

Figure 2:
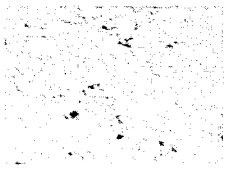

The attached FIG. 1 shows the microscopic photograph of the cross-section of the composite material of the present invention and FIG. 2 shows the microscopic photograph of the cross-section of a sintered body of titanium powders.

The following examples are given for the purpose of illustration of this invention and are not intended as limitations thereof.

EXAMPLE 1

To 5l of three-necked flask were added dropwise 2.5l of anhydrous xylene and 383g of sodium and 1l of dimethyldichlorosilane under argon gas atmosphere. After completion of the addition, the mixture was circulated by heating for 8 hours under argon atmosphere to form precipitate. This precipitate was filtered and firstly washed with methanol and then washed with water to obtained 415g of white powdery polysilane. 200g of obtained polysilane was charged in an autoclave of 1l and reacted at 450° C. for 20 hours. After completion of the reaction, the reaction product was dissolved in n-hexane and the solution was taken out from an autoclave and filtered and then concentrated by heating at 150° C. by means of a vacuum pump to obtain 120g of solid organosilicon high molecular weight compound. 10g of the organosilicon high molecular weight compound was dissolved in 50cc of n-hexane and 90g of titanium powders of less than 250 meshes was added thereto and thoroughly mixed and then the mixture was dried at room temperature in air and a molding of 5mm×5mm×120mm was obtained by a pressure press. This molding was heated to 1300° C. under vacuum at a temperature raising rate of 100° C./hr and 1300° C. was kept for 5 hours to obtain a heat resistant and super hard metallic composite material according to the present invention. This metallic composite material was determined by X-ray diffraction and the presence of titanium metal, titanium carbide and silicone carbide was confirmed. The hardness of this metallic composite material is compared with that of TiC series super hard alloy WZ-12C in the following Table 7.

Table 7

| Sample | Vickers Hardness |
|---|---|
| WZ-12C | 820 |
| This invention | 1980 |

As seen from the above data, the composite material according to the present invention is 2.5 times as hard as WZ-12C. A test of oxidation resistance of both the samples was effected at 700° C. for 3 hours. The composite material according to the present invention was not substantially oxidized and the weight increase was 1.1g/cm$^2$/hr, while the oxidation of WZ-12C was very large and the weight increase was 21g/cm$^2$/hr.

EXAMPLE 2

200g of tetramethylsilane and 30g of $CoC_6H_5O_3$ were charged in 1l of autoclave and the mixture was reacted at 440° C. for 15 hours. After the completion of reaction the reaction product was dissolved in n-hexane and the solution was taken out from the autoclave and filtered and then concentrated by heating up to 150° C. under vacuum to obtain 84g of organosilicon high molecular weight compound containing cobalt element. 10g of this organosilicon high molecular weight compound was dissolved in 50cc of n-hexane and to this solution was added 90g of tungsten powders of less than 200 meshes and the mixture was thoroughly mixed and dried at room temperature. The dried powders were subjected to pressure press to obtain a molding of 3mm×5mm×30mm and the formed molding was heated up to 1500° C. under hydrogen gas atmosphere at a temperature raising rate of 200° C./hr and 1500° C. was kept for 4 hours to obtain the metallic composite material. This metallic composite material was compared with 95WC-5Co cermet with respect to the hardness and flexural strength. The obtained result is shown in the following Table 8.

Table 8

| Sample | Hardness ($R_A$) | Flexural strength (kg/cm$^2$) |
|---|---|---|
| 95WC:5Co | 92 | 12250 |
| This invention | 186 | 24300 |

The composite material according to the present invention is twice as large as 95WC-5Co in hardness and strength. Both the samples were used as a cutting tool and the cutting test of grey cast iron was effected. The composite material according to the present invention showed the durability of 2.5 times as long as 95WC-5Co.

EXAMPLE 3

200g of dodecamethylcychlohexasilane and 10g of hexamethyldisilasane were charged in an autoclave and air in the autclave was substituted with argon gas and then the mixture was reacted at 480° C. for 2 hours to obtain 125g of organosilicon high molecular weight compound. 20g of the organosilicon high molecular weight compound was dissolved in 60cc of benzene and 80g of silicon powders of less than 300 meshes was added thereto and the mixture was thoroughly mixed. Then, benzene was removed to obtain the starting material for forming a mold. This material was subjected to a pressure press to form a molding of 20mm×20mm×20mm and the formed molding was heated up to 1300° C. under argon gas atmosphere at a temperature raising rate of 100° C./hr and 1300° C. was kept for two hours to obtain a heat resistant and super hard metallic composite material. This composite material was measured by X-ray diffraction. As a result, a major part was silicon carbide and a small amount of silicon metal and a slight amount of silicon nitride were recognized. The crushing strength of the metallic composite material was very large as 15.5 ton/cm$^2$, while the highest crushing strength of the sintered molding produced from silicon carbide through hot press was 10 ton/cm$^2$, so that the composite material of the present invention is 1.5 times as large as this sintered molding.

EXAMPLE 4

5g of organosilicon high molecular weight compound obtained in Example 1 and 95g of nichrome alloy (nickel: 80%, chromium: 18%, iron: 1%, manganese: 1%) of less than 250 meshes was added to 20g of heated and melted polystyrene to obtain a paste-like mixture.

This paste-like mixture was extruded through a nozzle having a diameter of 1mm to obtain a wire having a diameter of 1mm. This wire was heated up to 1300° C. under vacuum at a temperature raising rate of 50° C./hr and 1300° C. was kept for 1 hour to obtain nichrome wire having a diameter of about 0.9mm. An electric current passsed through this nichrome wire and a nichrome wire having the same composition as in this Example and these wires were red heated to effect a heat resistant test. The durability of the nichrome wire according to the present invention was 2.5 times as long as the conventional nichrome wire and was very excellent in heat resistance.

The heat resistant and super hard metallic composite materials according to the present invention were excellent in the heat resistance, corrosion resistance and abrasion resistance and high in the hardness and had a higher toughness than the conventional super hard material, so that the metallic composite materials of the present invention can be used for heat resistant materials, such as turbine blade, press mold abrasion resistant nozzle, gas turbine, jet engine, rocket engine and the like, machine parts, magnetron cathode materials, resistant heating element, electric contact, semiconductor, magnetic materials, cutting tool and in all field where the conventional super hard materials and cermets can be heretofore used.

What is claimed is:

1. A method for producing a heat resistant and super hard composite materials, which comprises mixing not more than 60% by weight of an organosilicon high molecular weight compound, the main skeleton components of which are silicon and carbon or an organosilicon high molecular weight compound, the main skeletion components of which are silicon and carbon and which contains foreign elements other than silicon, carbon, hydrogen and oxygen with not less than 40% by weight of metal material powders consisting mainly of at least one metal element selected from the group consisting of zirconium, hafnium, titanium, thorium, uranium, chromium, silicon, tungsten, vanadium, molybdenum, manganese, boron, niobium, tantalum or beryllium, molding the mixture into a shaped article and baking the shaped article under a non-oxidizing atmosphere at a temperature of lower than the semi-melting point of the above described metal powders.

2. The method as claimed in claim 1, wherein the baking is effected under pressure.

3. The method as claimed in claim 1, wherein the molding is effected under pressure.

4. The method as claimed in claim 1, wherein the non-oxidizing atmosphere is vacuum, inert gas, hydrogen gas, CO gas, $CO_2$ gas, hydrocarbon gas or organosilicon gas.

5. Heat resistant and super hard composite materials having a Vickers hardness of 1540 to 2170 consisting mainly of at least one of metal carbides and at least one of the metals that form such metal carbides and containing a small amount of a silicate of the above described metals or $\beta$-type SiC.

6. Heat resistant materials according to claim 5 wherein said metal carbides have a microhardness of 700 to 5000 kg/mm$^2$.

* * * * *